US006040525A

United States Patent [19]

Chauquet et al.

[11] Patent Number: 6,040,525

[45] Date of Patent: Mar. 21, 2000

[54] ELECTRICAL CLIP AND METHOD

[75] Inventors: Jacques Chauquet, Ayse-Bonneville; Jean Claude Fuchs, L'Etrat, both of France

[73] Assignee: Erico International Corporation, Solon, Ohio

[21] Appl. No.: 08/843,223

[22] Filed: Apr. 14, 1997

Related U.S. Application Data

[60] Provisional application No. 60/015,613, Apr. 18, 1996.

[51] Int. Cl.[7] ..... H02G 7/00

[52] U.S. Cl. ..... 174/40 CC; 439/100; 439/112

[58] Field of Search ..... 174/40 CC, 84 C, 174/88 B; 361/822, 823; 439/100, 110–114

[56] References Cited

U.S. PATENT DOCUMENTS

| | | | |
|---|---|---|---|
| 3,551,876 | 12/1970 | Walter | 439/810 |
| 3,594,682 | 7/1971 | Oleson | 439/100 |
| 3,727,171 | 4/1973 | Coles et al. | 439/110 |
| 3,836,941 | 9/1974 | Izraeli | 439/431 |
| 4,601,531 | 7/1986 | Wider | 439/810 |
| 5,358,423 | 10/1994 | Burkhard et al. | 439/402 |

FOREIGN PATENT DOCUMENTS

| | | |
|---|---|---|
| 0435026A1 | 7/1991 | European Pat. Off. . |
| 3724883A1 | 2/1989 | Germany . |
| 3724884A1 | 2/1989 | Germany . |

OTHER PUBLICATIONS

European Search Report dated Aug. 1, 1997, for European Patent Application No. 97106214.6.

"Eriflex® System" copyright Mar. 1994 by Erico®, pp. 25 and 59.

*Primary Examiner*—Nestor Ramirez
*Assistant Examiner*—Joseph Waks
*Attorney, Agent, or Firm*—Renner, Otto, Boiselle & Sklar, P.L.L.

[57] ABSTRACT

An electrical clip for attaching an electrical conductor to the face of a bar characterized by a U-shaped rigid housing having opposed windows through which a conductor may be inserted, spring legs shaped to embrace and snap around both edges of a bus bar and hold the bus bar securely. The clip also includes a clamp screw and blade to compress a conductor inserted through the windows against the face of the bus bar.

18 Claims, 1 Drawing Sheet

ELECTRICAL CLIP AND METHOD

This Application claims the benefit of U.S. Provisional Application No. 60/015,613 filed on Apr. 18, 1996.

FIELD OF THE INVENTION

The present invention relates generally to an electrical clip. More particularly, the invention relates to an improved construction of such clip for attaching a conductor to the face of a bus bar.

BACKGROUND

Electrical connectors and, in particular, those used for the connection of a conductor to the face of a bus bar have been used in industry. The electrical connection between conducting wires and the bus bars of a panel board for example utilizes several systems. One approach has been to drill and tap holes in the copper or aluminum bus bars and attach suitable terminal lugs in the bus bars by means of bolts passing through the lugs into the tapped holes. The lugs may be crimped to the bare conductor wire. Where the hole is not tapped, nut, bolt and washer assemblies are required. The connection is of course not adjustable and is limited to the position of the hole or holes.

In switch board low voltage connections of wire (stranded or solid) on copper bars not using bar holes, two general types of connectors have been developed. One, shaped like a letter G fits on a bar edge. The top includes a clamp screw which drives a blade against the bare conductor clamping it to the edge of the bar face. While this type of connector can be added after bar assembly and positioned substantially anywhere along the bar, it suffers several drawbacks. One drawback in that it can be overtightened. This causes the clip to open. The opening results from the torque applied on the screw and the reaction along a single edge of the bar. Opening may result in clip failure or looseness. It would be desirable if the torque reaction could be at both edges and generally symmetrical to both edges.

The other type of connector has rectangular openings in both legs and requires to be threaded on the end of a bar before assembly on the insulators. If a modification is required or even one additional connector wire is needed, the bar and possibly the connections may have to be dismantled and then reconnected, which takes time and care.

It would accordingly be desirable to have a snap-on clip which would grip both edges of the bar and position the clamp screw generally in the center of the bar. It would also be desirable to have a clip which would be generally symmetrical of the bar edges and which can be placed at any location along the bar length, all without disassembling the bar or other connections. It would also be desirable to have a clip of exceptional strength and rigidity not subject to distortions, overtightenings or openings.

SUMMARY OF THE INVENTION

With the foregoing in mind, the present invention provides an electrical clip for attaching an electrical conductor to the face of a bar characterized by a U-shaped housing having opposed windows through which a conductor may be inserted, spring legs shaped to embrace and snap around both edges of a bus bar and hold the bus bar securely at both edges. The clip also includes a means to compress a conductor inserted through the windows against the face of the bus bar.

In one particular embodiment of the invention, an electrical clip for attaching an electrical conductor to the face of a bar is provided, including a rigid housing having opposed windows into or through which a conductor may be inserted, the housing also having two opposed spring legs shaped to embrace and snap around both edges of a bar, the housing being open to a face of the bar. A clamp screw is positioned on the housing and an associated blade assembled with the screw is used to compress a conductor inserted through one or both windows against the face of the bar. The spring legs are formed from two walls of the housing and deep flanges extend between the legs stiffening the housing and confining the conductor.

The following description and the annexed drawing set forth in detail certain illustrative embodiments of the invention. These embodiments are indicative, however, of but a few of the various ways in which the principles of the invention may be employed.

DETAILED DESCRIPTION OF THE PREFERRED EMBODIMENTS

Figure 1:
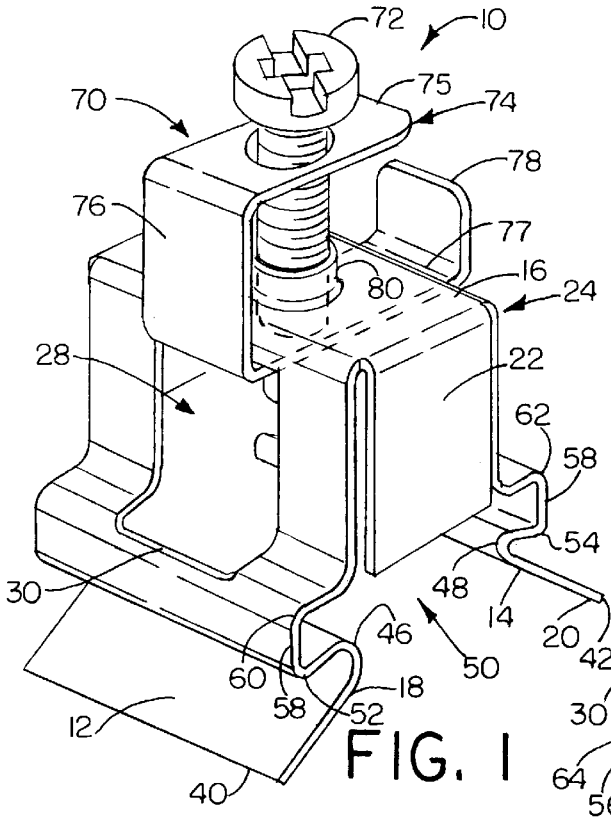
FIG. 1 is a perspective view of an electrical clip in accordance with the invention.
Figure 2:
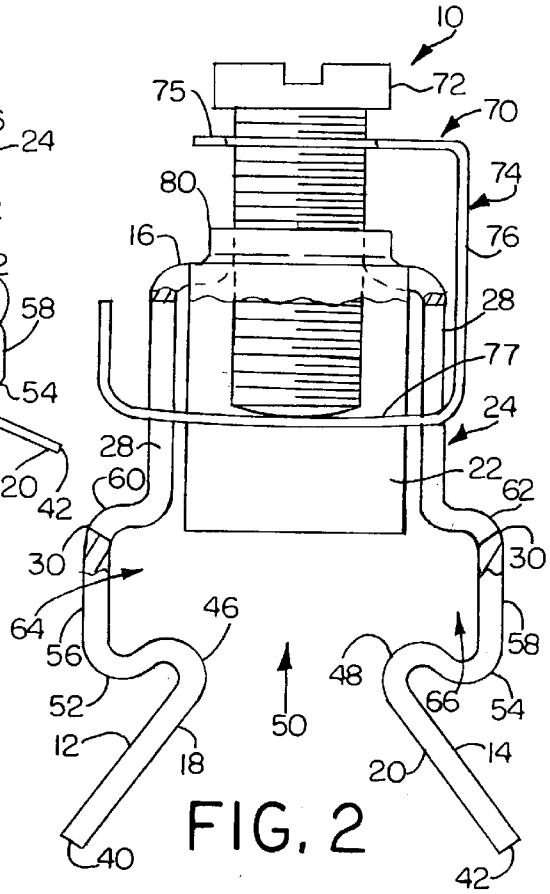
FIG. 2 is an edge elevation partially broken away and in section of the electrical clip.
Figure 3:
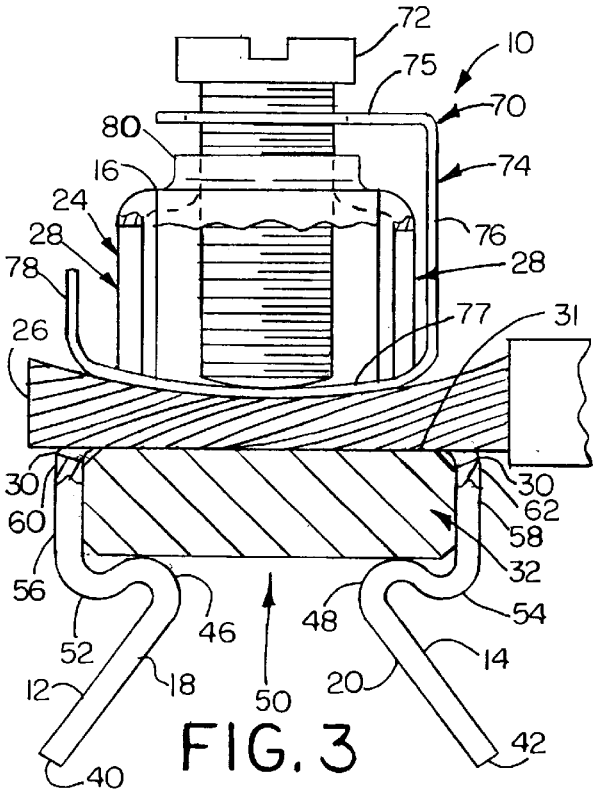
FIG. 3 is a similar view of the clip attaching a conductor to the face of a bar.
Figure 4:
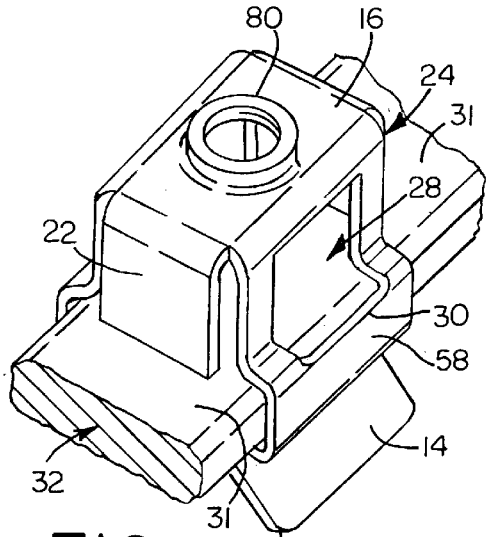
FIG. 4 is a perspective view of a clip snapped onto a bar.

Referring initially to FIGS. 1–3, an electrical clip in accordance with the invention is generally indicated at 10. The clip 10 is generally U-shaped and is formed of spring steel.

The clip includes two resilient lateral support side legs 12 and 14 which are adapted to embrace both edges of electrical bus bars or the like. Legs 12 and 14 extend from the ends of top plate portion 16 and terminate in flared foot sections 18 and 20. Additionally, a pair of fairly deep lateral stiffening flanges 22 extend from the lateral sides of the plate 16 and between the legs 12 and 14. The upper portion of the legs 12 and 14, the plate 16, and the stiffening flanges 22 form a housing shown generally at 24. The stiffening flanges 22 serve dual purposes of providing structural integrity to the clip 10 and to isolate the exposed tip of the conductor 26. The flanges 22 afford the clip 10 exceptional strength and rigidity. The upper leg portions of the housing 24 further includes opposed windows 28 which permit entry of the bare end of conductor 26 through either side of the clip 10. The bottom edges 30 of the windows 28 are formed so that they are below the conductor 26 when the conductor is compressed against the face 31 of the bus bar 32.

The foot sections 18 and 20 extend generally away from each other in a spatial relationship between their tip edges 40 and 42 respectively. The spatial relationship of the foot sections 18 and 20 at the tip is slightly wider than the bus bar 32.

Moving from the tips of the foot sections 18 and 20, the legs 12 and 14 slope toward each other to respective rounded heels 46 and 48, where the distance between the heels is less than the width of the bus bar 32. At the heels 46 and 48, the legs 12 and 14 each form a recess 50 into which the bus bar 32 securely snaps into place.

The recess 50 is defined by bends of the legs 12 and 14. From the rounded heels 46 and 48, the legs are rebent inwardly and upwardly to form rounded bends 52 and 54.

From the rounded bends 52 and 54, the legs 12 and 14 rebend upwardly to form the sides 56 and 58 of the recess 50. Above the recess sides 56 and 58, the legs are again rebent inwardly to form rounded bends 60 and 62. From the horizontal reach of the bends 60 and 62 the legs are rebent vertically to form the upper leg portion which forms the housing side wall and in which the majority of the respective window is located.

As the clip 10 is pushed against the bus bar 32, the legs 12 and 14 spread to receive the bus bar until it snaps into place in the recess 50 with the heels snapping around the bus bar edges. In the preferred embodiment, the two legs 12 and 14 are symmetrical and of the same length. The symmetry of the legs affords a tight clamping and any torque reaction is balanced at both edges of the bus bar 32 and generally symmetrical to both edges.

The legs then form opposed inwardly opening notches seen at 64 and 66 in FIG. 2 defining the lateral tremities of the recess 50. The recess 50, when the legs are sprung apart, defines an area that is substantially equivalent to the transverse area of the bus bar 32. Accordingly, after the bus bar traverses the heels 46 and 48 the edges snap into the respective notches 64 and 66 and the bar is captured and locked into the recess 50. The clip may be sized in accordance with the size of the bus bar that it is to clamp and receive.

The clip 10 is securable by finger pressure, and may easily be pried off the bar if desired. Thus, the clip 10 affords quick installation or dismantling.

In FIGS. 1–3, the clip 10 as illustrated includes a clamp 70 that is employed to compress the conductor 26 to the bus bar 32. The clamp 70 in the preferred embodiment includes a clamp screw 72 and an assembled blade 74. The blade 74 is shaped like a G and has a top leg 75, a vertical side 76 and a bottom leg 77 generally parallel to the top leg. The bottom leg 77 terminates in an upturned tip 78 generally parallel to the side 76. The top 16 of the clip housing 24 includes an extruded threaded hole 80 which accommodates the clamp screw 72. The extruded threaded hole 80 receives the threads of the clamp screw 54 as it turns pressing the blade 74 against the conductor 26 to clamp firmly the conductor to the face of the bus bar 32. The clamp screw 72 assures intimate contact of the wire and simultaneously fixes the location of the clip 10 on the bus bar 32 at a desired location. The bottom leg of the blade may have a concave transverse curvature to match somewhat the top surface of the bare wire.

Thus, the clip 10 provides for a strong connector of a conductor 26 to a bus bar 32, the clip 10 being slidable along the bus bar 32 for ideal positioning. Additionally, the clip 10 can be clamped to the bus bar 32 or removed from the bus bar without having to disassemble the bus bar or other connections already made. The clip 10 also affords easier attachment of the conductor 26 to the bus bar 32 since it can in one step be clamped on to the bus bar 32 and in a second step receive the conductor 26 through either or both windows 28. Moreover, the clip 10 assures a strong and reliable connection between the conductor 26 and the bus bar 32.

To the accomplishment of the foregoing and related ends, the invention then, comprises the features hereinafter fully described and particularly pointed out in the claims.

What is claimed is:

1. An electrical spring steel clip for attaching an electrical conductor to a bus bar having a face and opposed edges comprising a housing having at least one window through which said conductor is inserted transversely of said bus bar, said housing having two spring legs shaped to embrace and snap around both edges of said bus bar, said housing being open to said face of the bus bar, and means on said housing to clamp a conductor inserted through said window against said face of the bus bar.

2. The clip of claim 1 wherein said at least one window is two windows, one in each of said legs.

3. The clip of claim 2 wherein said spring legs each includes an inwardly opening notch to embrace and snap around each of said edges of the bus bar, respectively.

4. The clip of claim 3 wherein the bus bar has a cross-sectional area and each notch has a cross-sectional area and the cross-sectional area of each of said notches is substantially equal to the cross sectional area of each of the bar edges.

5. The clip of claim 4 wherein one edge of each of the windows is below the conductor when clamped against the face of the bus bar.

6. The clip of claim 2 wherein said housing includes stiffening flanges extending between said legs.

7. The clip of claim 6 wherein said stiffening flanges extend to enclose said housing and serve to guide and isolate a conductor inserted through one or both of said windows.

8. The clip of claim 1 wherein said means to clamp said conductor comprises a clamp screw and blade, the clamp screw being engageable with said housing and the blade to effect clamping of the blade against the conductor in order to achieve an attachment of the conductor to the face of the bus bar.

9. The clip of claim 8 wherein said housing includes an extruded threaded hole accommodating said clamp screw.

10. The clip of claim 8 wherein said blade is generally a G-shape, having a top leg, a side leg and a bottom leg, the bottom leg bearing against the conductor.

11. The clip of claim 10, wherein the top leg of said blade includes an aperture to receive the clamp screw.

12. A method of attaching an electrical conductor to a bus bar having a face and opposite edges comprising the steps of snapping a spring steel clip on said bus bar to engage both edges of said bar, inserting a conductor into said clip transversely of the bar and adjacent the bar face, and clamping the conductor against the bar face.

13. A method as set forth in claim 12 including the step of using a screw threaded in said clip to clamp the conductor to the bar face, said screw being symmetrically positioned with respect to said bar edges.

14. A method as set forth in claim 13 including the step of providing a conductor receiving window in said clip facing transversely of said bar, one edge of said window extending below the face of the bar and the conductor when clamped against the face of the bar.

15. In combination a generally rectangular bus bar having faces and opposite edges, a spring steel clip for securing a conductor to a face of the bus bar, said spring clip having legs each including inwardly opening notches adapted to snap over and embrace both edges of the bus bar, a window extending through at least one of said legs transversely of the bar, and clamp means to clamp said conductor extending through the window to the face of the bus bar.

16. The combination set forth in claim 15 wherein said clip legs snap over the bar edges to seat said bar edges in said notches when the clip is pushed normal to said face of the bar.

17. The combination set forth in claim 16 including two such windows each having an edge permitting the conductor to be clamped to said bar face without engaging the edge.

18. The combination set forth in claim 17 including a screw clamp in said clip, and a blade extending through both of said windows between the screw clamp and said conductor.

* * * * *